United States Patent [19]

Gray et al.

[11] Patent Number: 4,612,043

[45] Date of Patent: Sep. 16, 1986

[54] STEEL MAKING METHOD

[75] Inventors: Ronald D. Gray, Bethel Park; Michael A. Orehoski, Duquesne, both of Pa.

[73] Assignee: Pennsylvania Engineering Corporation, Pittsburgh, Pa.

[21] Appl. No.: 595,313

[22] Filed: Mar. 29, 1984

[51] Int. Cl.[4] ..... C21C 7/10

[52] U.S. Cl. ..... 75/49; 75/59.12

[58] Field of Search ..... 75/49, 59, 60

[56] References Cited

U.S. PATENT DOCUMENTS

| | | | |
|---|---|---|---|
| 3,230,074 | 1/1966 | Roy | 75/49 |
| 3,761,242 | 9/1973 | Finkl | 75/49 |
| 4,104,057 | 8/1978 | Maas | 75/49 |
| 4,378,242 | 3/1983 | Harris | 75/49 |

OTHER PUBLICATIONS

Secondary Steelmaking–Refining Process in the USA Booklet–Secondary Steelmaking.

*Primary Examiner*—Peter D. Rosenberg

*Attorney, Agent, or Firm*—Fred Wiviott

[57] ABSTRACT

A method of making steel having low levels of carbon, nitrogen, phosphorous and oxygen comprises the steps of vacuum reladling a ladle of low phosphorous steel for reducing carbon levels and separating the metal from a highly oxidizing slag, blowing oxygen into the metal contained in a teeming ladle at a vacuum pressure and simultaneously bubbling an inert gas through the metal for removing additional carbon and elevating the temperature of the metal, discontinuing the oxygen blow while maintaining the vacuum pressure and continuing the delivery of inert gas for removal of nitrogen. A desulphurizing agent may be delivered prior to the oxygen blow and alloying additions may be made as required.

20 Claims, 4 Drawing Figures

STEEL MAKING METHOD

BACKGROUND OF THE INVENTION

This invention relates to a unique combination of secondary refining processes external to the steelmaking furnaces such as the electric-arc, the BOF o the Q-BOP, for producing steels having any or all the combinations of the following elements in very low concentrations: Carbon content at less than 0.01% for most grades and at less than 0.0025% for some grades; phosphorous content at less than 0.010% for most grades and at less than 0.002% for some grades; sulfur content at less than 0.010% for most grades and at less than 0.002% for some grades; nitrogen content at less than 0.010% for most grades and at less than 0.0025% for some grades; hydrogen content at less than 0.0001% for most grades; and aluminum killed for most grades and less than 0.005% aluminum content for some grades.

The secondary refining processes can be performed in ladles, special vessels or molds and include vacuum degassing methods (vacuum ladle-to-ladle stream degassing, vacuum-oxygen refining, and vacuum ladle degassing), which by proper sequencing can produce the aforementioned grades of steel with restricted low chemical composition limits.

The inventors recognize that the ladle refining processes (vacuum ladle-to-ladle stream degassing, vacuum-oxygen refining, and vacuum ladle degassing) selected for producing the aforementioned grades of steel are presently being practiced separately but to their knowledge the processes have not been combined or properly sequenced to produce the aformentioned steel chemistries.

The presence of furnace slag in secondary or ladle refining processes has been recognized as a deterrent by those who are proficient in the art. Furnace slags may contain varying amounts of compounds of phosphorous, sulfur, iron, silicon, and alkalies which will contaminate the steel and/or erode the refractory linings in the ladles during the refining processes.

Several methods are used to separate the furnace slag from the steel in preparation for subsequent ladle refining processes. Although any of the positive methods for separating the furnace slag from the steel for subsequent ladle refining processes would be acceptable for the production of the aforementioned special steels, the two selected by the inventors are reladling and slag skimming. If the reladling process is selected (and it is preferred by the inventors), it should be performed by the vacuum ladle-to-ladle stream degassing method. The steel for this process should not be aluminum killed prior to reladling thereby permitting the removal of carbon, nitrogen, hydrogen, and part of the oxygen from the steel during the reladling operation. Also, as described in the embodiment of the patent, it may be necessary to use the slag skimming process for the grades of steel that require low (<0.005%) aluminum contents in addition to the very low residual concentrations of the other elements.

For many grades of stee where low (<0.01%) carbon contents are not required, it is common practice to use the ladle electric-arc reheating process for further refining the steel and for obtaining the desired steel temperature. However, for the grades of steel described herewith, ladle arc reheat process would not be acceptable because of the pickup of carbon from the graphite electrodes during arc reheating. To reheat the steel and to obtain the desired steel temperature the inventors employ chemical reheating by the addition of oxidizable elements, such as aluminum, to the steel and selective oxidation of the element by gaseous oxygen blown onto the steel within an enclosure where the absolute pressure in the enclosure is less than one atmosphere.

For the special grades of steel that require very low phosphorus and nitrogen contents it may be necessary to remove part or most of these undesirable elements by practices prior to the processes included in the embodiment of the invention.

The purposes for selecting the various ladle refining processes and their sequence of operations become apparent in the description of the invention.

SUMMARY OF THE INVENTION

It is an object of the invention to provide a new and improved steel making method.

Another object of the invention is to provide a method of making steel having extremely low levels of carbon, phosphorous, sulphur, hydrogen, oxygen and nitrogen.

In general terms, the invention comprises a method of making steel including the steps of passing molten steel having excess amounts of carbon, hydrogen and oxygen from a first ladle located above an opening in a vacuum chamber and collecting the metal in a second ladle disposed within the vacuum chamber, maintaining a high vacuum pressure within the chamber while the metal is being transferred between ladles for removing carbon and gases disolved in the metal, terminating the metal transfer before any appreciable quantity of slag which may be contained on the metal within the first ladle is permitted to flow to the second ladle, delivering an inert gas to the metal in the second ladle to promote stirring during the transfer of metal from the first ladle to the second ladle, adding uneven roll scale, adding aluminum and desulfurizing slag to the metal in the second ladle and blowing oxygen into the metal to oxidize the aluminum thereby to elevate the temperature of the metal while continuing to deliver inert gas into the metal within the second ladle and maintaining vacuum pressure within the chamber, discontinuing the blowing of oxygen and reducing the pressure in the vessel to a high vacuum while continuing to deliver inert gas to the molten metal and the second ladle.

DETAILED DESCRIPTION OF THE PREFERRED EMBODIMENT

Figure 1:
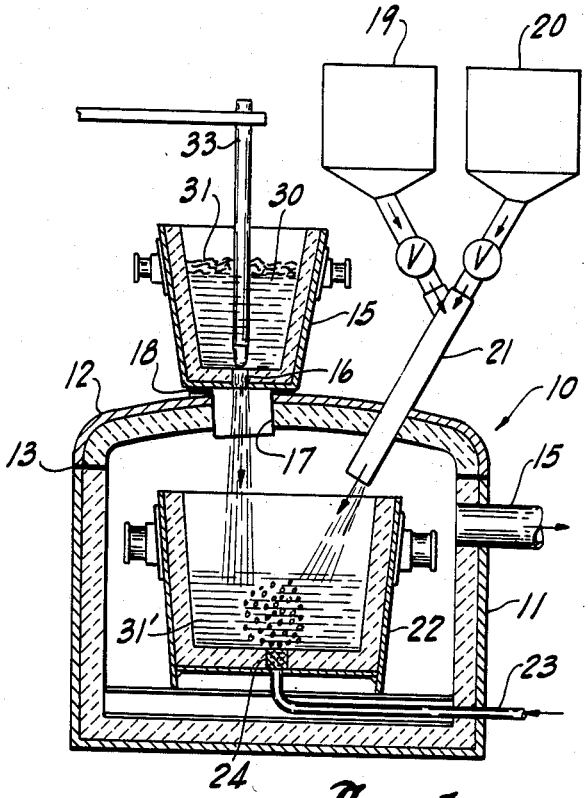
FIG. 1 illustrates apparatus in which the initial steps of the method according to the invention are performed.
Figure 2:
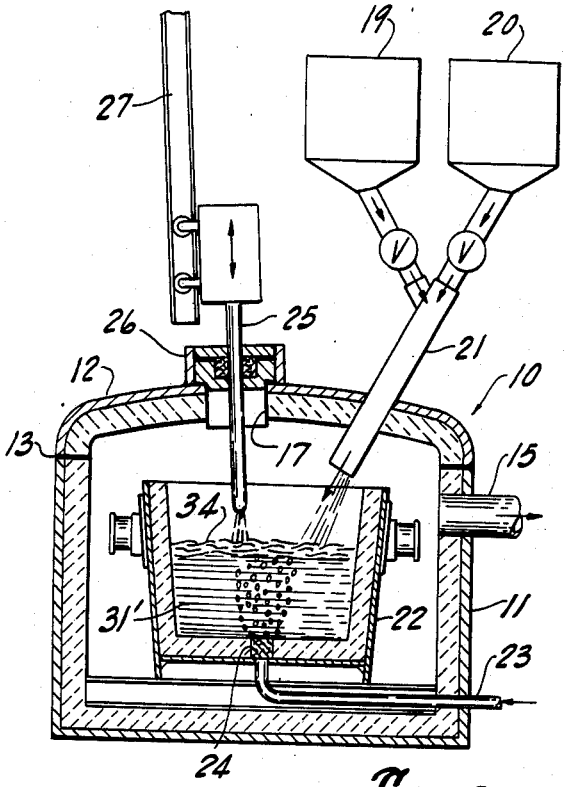
FIG. 2 shows an apparatus in which subsequent steps of the method according to the invention are performed.
Figure 3:
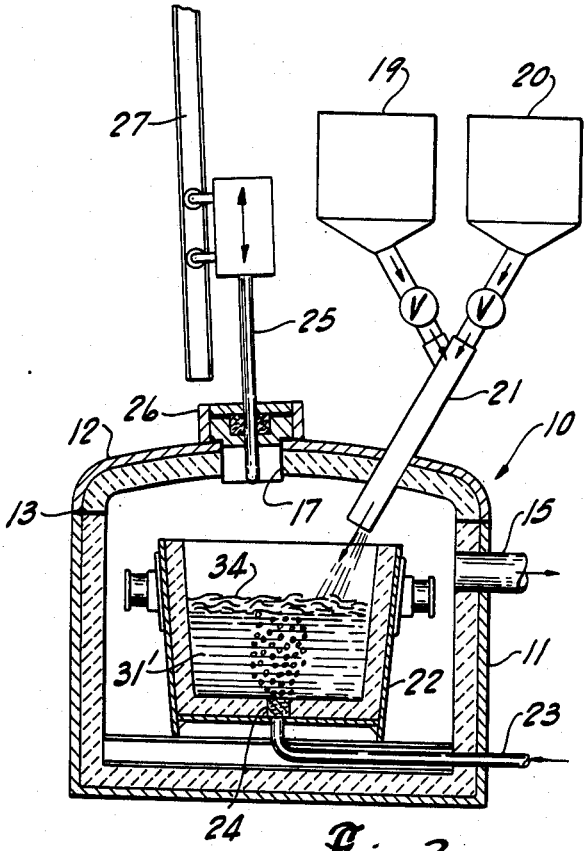
FIG. 3 illustrates the apparatus during the performance of the concluding steps of the process according to the invention.

FIGS. 1, 2 and 3 show the apparatus in which the process according to the invention may be performed. Since this apparatus is conventional, it will be discussed only in general terms. It will be understood that the apparatus discussed herein is merely presented for purposes of understanding the process of the invention and it is not intended to limit the scope of the method according to the invention to the specific apparatus disclosed.

In particular, FIG. 1 shows the apparatus for performing the initial steps to comprise a stream degassing apparatus which includes a vacuum chamber 10 consisting of a housing 11 and a removable cover 12 whose outer periphery is complimentary with the upper rim of housing 11. A vacuum tight seal 13 is disposed between the housing 11 and the cover and the interior of the housing 11 is connected to a vacuum system (not shown) by a pipe 14. As those skilled in the art will appreciate, the vacuum system may comprise any conventional vacuum apparatus, such as a vacuum pump or a steam ejector for disposal atop the cover 12. Disposed atop the cover 12 is a tapping ladle 15 having a bottom discharge nozzle 16 which is in registry with an opening 17 in cover 12. A vacuum seal 18 is provided between the tapping ladle 15 and the cover 12 and in surrounding relation to the nozzle 16 and the opening 17. In addition, sealed feed hoppers, such as 19 and 20, are connected to a chute 21 which extends in a sealed relation through the cover 12. While a pair of hoppers 19 and 20 are shown, those skilled in the art will appreciate that any number of hoppers may be provided depending upon the number of additions to be made. Alternatively, the hoppers may be subdivided into various compartments for different additives. After being charged, the hoppers will remain sealed throughout the process.

Figure 4:
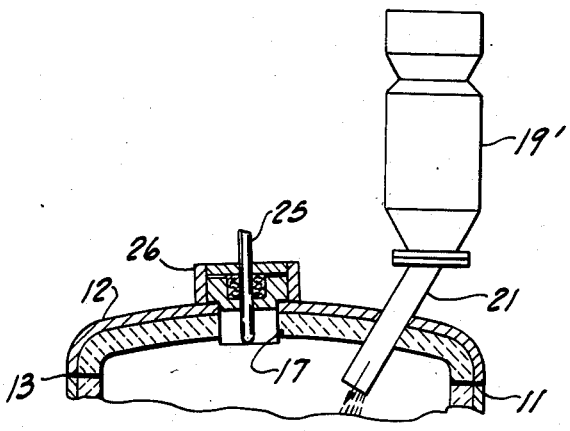
FIG. 4 illustrates an alternate apparatus which may be employed for performing the method of the invention.

In a further modification shown in FIG. 4, a vacuum lock 19' is used in place of the hoppers 19 and 20. Since vacuum locks are well known in the art, they need not be described in further detail here.

Suitably supported in the lower end of vacuum chamber 10 is a teeming ladle 22. A flexible conduit 23 extends in a sealed relation through the side of housing 11 and connects at one end to a porous or gas permeable refractory plug 24 in the lower end of the teeming ladle 22. The other end of conduit 23 is connected to a source of an inert gas, such as argon (not shown). Those skilled in the art will appreciate the teeming ladle may itself comprise the vacuum chamber. In that case the cover will seal to the upper rim of the teeming ladle and the vacuum and the gas connections will pass through the cover.

FIGS. 2 and 3 show the illustrated apparatus in alternate modes for performing subsequent steps of the process. The apparatus illustrated in FIGS. 2 and 3 are the same as described with respect to FIG. 1, except that an oxygen lance 25 extends through opening 17. A vacuum tight seal 26 surrounds the lance 25 and the opening 17 to provide a vacuum joint therebetween. The oxygen lance 25 is conventional and is illustrated as being mounted on a positioning assembly 27 so that the lance may be moved toward and away from the teeming ladle 22.

In the process of the invention, the steel 30 is poured from a furnace (not shown) into the tapping ladle 15. Normally the steel 30 is covered by a layer of slag 31 which may, for example, be highly oxidizing if the steel has been dephospherized prior to charging to the furnace or during the furnace blowing, refining or tapping operations. In order to prevent chemical reaction reversions and contamination, the slag must be removed prior to further treatment or casting. For this reason also, the refractory linings of the tapping and teeming ladles 15 and 22 must be nonreactive with the metal 30.

The first step of the method according to the invention is performed by vacuum reladling the metal 30 by a stream degassing operation while the metal in the teeming ladle 21 is mixed by argon stirring. The vacuum reladling or stream degassing is accomplished by placing the tapping ladle on the cover 12 and engaging the seal 18 which surrounds the nozzle 16 and the opening 17. Once the vessel has been sealed the vacuum system (not shown) is activated and the pressure within the housing 11 is reduced to about one Torr. The stopper rod 33 is then elevated in the tapping ladle 15 allowing the molten metal to flow downwardly through nozzle 16 and into the housing 11 where the vacuum causes the metal to subdivide into numerous small droplets. This increases the surface area exposed to the vacuum and provides a relativly short difusion path for disolved gases. As the result, hydrogen and other gases in the metal are readily removed. In addition dissolved carbon and oxygen react forming carbon monoxide gas which is removed by the vacuum pumping system, thereby removing both carbon and oxygen from the liquid steel melt.

The molten metal falling from the tapping ladle 15 collects in a pool 31' within the teeming ladle 22. Simultaneously, argon is delivered through the pipe 23 to the porous refractory plug 24 and bubbles upwardly through the molten metal 31'. This stirs the molten metal to promote homegenity and increases the surface area of the molten metal exposed to the vacuum. For those grades requiring very low carbon contents, that is below 0.005%C, roll scale or iron ore may be added to the teeming ladle from one of the hoppers 19 or 20 to facilitate further carbon removal. After substantially all of the metal 30 has discharged from lable 15, the stopper rod 33 is replaced before any appreciable among of slag 31 passes through nozzle 16. Thus, the first step is one of vacuum decarbonization simultaneous with vacuum degassing and includes separation of the melt from the oxidizing slag.

Following decarbonization, it is necessary to desulfarize the steel to meet low sulfur requirements for most grades of steel. This is accomplished in the apparatus as shown in FIG. 2. It can be seen that the tapping ladle 15 has been removed and replaced by the oxygen lance 25 with a seal 26 fixed around the opening 17. In addition, a desulphurizing agent, such as a mixture of about 40–80% lime with the balance fluorspor and alumina and aluminum are added to the steel from the hoppers 19 or 20. The vacuum is then reestablished within the chamber 10 as oxygen is projected into the metal 31' from the lance 25 and argon is bubbled through the metal from the porous plug 24. The reaction between the oxygen and the aluminum will elevate the temperature of the metal about one hundred to one hundred fifty degrees Fahrenheit, thereby replacing the heat lost during previous processing steps of tapping, transporting the metal to the treatment station, vacuum reladling, and the replacement of the tapping ladle by the oxygen lance apparatus. Typically, this temperature drop will be from about 2915° F. to about 2830° F. and the temperature rise during chemical reheating will be between about 100° F. to 170° F.

The interaction between the metal 31' and the desulfurizing slag 34, which is promoted by the mixing action of the argon, will result in desulfurization. The level of sulfur in the steel will be reduced in this manner to less than 0.002%. During the desulfurizing and reheating step, the vacuum within the vessel is maintained at between 0.2 and 200 Torr. At this time alloying additions may be made from the hoppers 19 and 20 or via the vacuum lock 19. Subsequent steps in the method will be dependent upon the grade of steel being produced.

Typical chemical analysis of several grades of steel which can be produced using the present invention are listed in Table I. The specific practices for the production of these grades are described as follows.

GRADES A, B, C, D

After the steel is reheated from about 2840° F. to about 2935° F. in the case of Grades A and B and from about 2829° F. to about 2917° F. in the case of Grades C and D, the lance 25 is retracted as shown in FIG. 3, and the vacuum is reduced again to one orr or lower. In addition, the delivery of argon through the porous plug continues. This further degassification of the metal reduces the hydrogen content to below 0.0001%. At this time, alloying additions will be added from one of the hoppers if the same were not added at the end of ladle reheating. After degassing is completed, the chamber 10 is repressurized, the tank cover removed, and the teeming level elevated and transported to casting apparatus, such as a continuous casting machine.

GRADES E AND F

After the steel is reheated from about 2826° F. to about 2966° F. in the case of Grade E and from about 2840° F. to about 2980° F. in the case of Grade F, the chamber 10 is repressurized, the cover removed, and the ladle 22 elevated and transported to a station where the ladle 22 is tilted and the slag 33 removed in any conventional manner, such as by means of a slag rake. The steel may be argon stirred during this step to assist in slag removal. After deslagging has been completed, the ladle 22 is returned to the chamber 10 and a second refining slag, which may be the same composition as the desulphurizing slag discussed above, is placed on top of the metal. This has the effect of retaining heat and enhancing chemical reactions. After this second refining slag has been added, the cover 12 is replaced and the vacuum reestablished while oxygen is delivered through the lance 25 and argon delivered to the porous plug 22 to promote stirring. The second oxygen blow will remove the aluminum in the steel to the desired level of below 0.005%. After the second oxygen blow has been completed, the lance 25 is retracted. The pressure within the chamber 10 may be then reduced from about 20–200 Torr to about 1 Torr while argon stirring continues. This reduces the hydrogen level to below 0.0001%. During this second vacuum treatment operation, alloy trim additions are made, if necessary. The metal is then in condition to be transported to the casting machinery.

The chemical composition of each of the grades of steel discussed above are shown in Table I and the temperature profiles are shown in Table II. Where percentages are given throughout the specification and in the tables, weight percentages are intended.

While only a few of the embodiments have been illustrated and described, it is not intended to limit the invention thereto but only to the scope of the patent claims.

TABLE I

CHEMICAL COMPOSITION OF TYPICAL GRADES OF STEEL

| REMARKS | A | B | C | D | E | F |
|---|---|---|---|---|---|---|
| Chemical Comp. % C | <0.005 | <0.0025 | <0.015 | <0.005 | <0.0025 | <0.0025 |
| Mn | 0.10/0.20 | 0.10/0.20 | 0.45/0.65 | 0.45/0.65 | 0.45/0.65 | 0.15/0.25 |
| P | <0.002 | <0.002 | 0.04/0.06 | 0.04/0.06 | 0.12/0.15 | <0.002 |
| S | <0.005 | <0.002 | <0.010 | <0.005 | <0.002 | <0.005 |
| Si | <0.010 | <0.010 | 0.55/0.70 | 0.55/0.70 | 0.10/0.20 | 0.005/0.020 |
| N | <0.003 | <0.003 | <0.005 | <0.003 | <0.003 | <0.0025 |
| Al | 0.03/0.05 | 0.03/0.05 | 0.23/0.30 | 0.23/0.30 | <0.005 | <0.005 |
| H | <0.001 | <0.001 | <0.001 | <0.001 | <0.001 | <0.001 |
| O | | | | | | |
| Ti | 0.06/0.08 | 0.04/0.06 | | | | |
| V | | | | | | |
| Cb | | | | | | |
| Cr | | | | | | |

TABLE II

TYPICAL PROCESS TEMPERATURE PROFILES FOR PRODUCTION OF THE TYPICAL GRADES

| Temperature °F. At Indicated Steps | A | B | C | D | E | F |
|---|---|---|---|---|---|---|
| BOF at TAP | 2982 | 2982 | 2973 | 2973 | 2980 | 2982 |
| ΔT During TAP | 57 | 57 | 61 | 61 | 69 | 57 |
| After TAP | 2925 | 2925 | 2912 | 2912 | 2911 | 2925 |
| Transport to Treat Station Etc. (10°ΔT) | 2915 | 2915 | 2902 | 2902 | 2901 | 2915 |
| Vacuum Stream Degas (70°ΔT) | 2845 | 2845 | 2832 | 2832 | 2831 | 2845 |
| Preparation For $O_2$ Reheat (5°ΔT) | 2840 | 2840 | 2827 | 2827 | 2826 | 2840 |
| $O_2$ Blow-Equiv. Reheat: Temp. Rise | 125 | 125 | 125 | 125 | 170 | 170 |
| Reheat: Final Temp. | 2935 | 2935 | 2922 | 2922 | 2966 | 2980 |
| Alloy Trim | 2930 | 2930 | 2917 | 2917 | | |
| Transport Ladle-Skim-Slag Transport Ladle (30°ΔT) | | | | | 2936 | 2950 |
| Add Synthetic Slag + $O_2$ Reblow (15°ΔT) | | | | | 2921 | 2935 |
| CaSi Injection (25°ΔT) | | | | | | |
| Vacuum Ladle Degas (30°ΔT) | 2900 | 2900 | 2887 | 2887 | 2891 | 2905 |
| Alloy Trim | | | | | 2886 | 2900 |
| Transport to Caster (5°ΔT) | 2895 | 2895 | 2882 | 2882 | 2881 | 2895 |
| Liquidus Temp. | 2795 | 2795 | 2782 | 2782 | 2781 | 2795 |

We claim:

1. A method of making steel comprising the steps of:

passing molten steel having excess amounts of carbon, sulfur hydrogen and oxygen from a first ladle to a second ladle disposed below the first ladle, maintaining a vacuum pressure in the space between the ladles while the metal is being transferred between ladles, said Vacuum being sufficient for removing carbon and disolved gases from said metal, terminating the metal transfer before any appreciable quantity of slag which may be disposed on the metal within the first ladle is permitted to flow through the second ladle, adding a metallic substance to the metal in the second ladle, said substance being readily oxidizable in a highly exothermic chemical reaction, blowing oxygen into said metal to oxidize the metallic substance thereby to elevate the temperature of the metal while continuing to deliver inert gas into the metal within the second ladle and maintaining vacuum pressure in said space, discontinuing the blowing of oxygen and reducing the pressure in the space to a vacuum sufficient to degas the metal in the second ladle while continuing to deliver inert gas to the molten metal in the second ladle.

2. The method set forth in claim 1 wherein the metallic substance is aluminum.

3. The method set forth in claim 2 wherein the inert gas is argon.

4. The method set forth in claims 1, 2 or 3 wherein a desulfurizing agent is added to the metal in the second ladle after transfer thereto from the first ladle for desulfurizing said metal while the pressure in the chamber is held at a high vacuum level and argon is delivered to the metal in the second ladle.

5. The method set forth in claim 4 wherein the metal in the second ladle is maintained under a vacuum pressure and the inert gas is delivered beneath the surface thereof, until the hydrogen content of the metal falls below 0.0001%.

6. The method set forth in claims 1, 2 or 3 wherein the metal in the second ladle is maintained under a vacuum and the inert gas is delivered beneath the surface thereof, until the hydrogen content of the metal falls below 0.0001%.

7. The method set forth in claims 1, 2 or 3 wherein the second ladle is disposed in a vacuum chamber, removing the second ladle from the vacuum chamber after oxygen blowing and transporting said second ladle to a deslagging station, removing the slag from the metal in the second ladle, returning the second ladle to the vacuum chamber, adding a synthetic slag, reestablishing the vacuum within the chamber and commencing a second oxygen blow to the metal in the second ladle, continuing the second oxygen blow until the level of aluminum is below 0.005%.

8. The method set forth in claims 1, 2 or 3 wherein the temperature of the metal in the second ladle is elevated to about 2815° F. to about 2930° F.

9. The method set forth in claims 1, 2 or 3 wherein calcium silicon is added to the metal in the second ladle after the oxygen blow.

10. The method set forth in claims 1, 2 or 3 wherein an iron oxide is added to the metal in the second ladle and the level of carbon is reduced to less than about 0.005%.

11. The method set forth in claims 1, 2 or 3 wherein the high vacuum pressure is about one torr.

12. The method set forth in claim 11 wherein the second ladle is at a pressure within the range 1 to 400 torr.

13. A method of making steel comprising the steps of positioning a container of molten steel having a slag layer thereon above a second container, passing the molten metal from the first container to the second container and through the vacuum, maintaining the second container at said vacuum pressure sufficient for removing carbon from said metal while the metal is being transferred between containers, terminating the metal transfer before any appreciable quantity of slag is permitted to flow from the first container to the second container, delivering an inert gas to the metal in the second container to promote stirring during the transfer of metal from the first container to the second container, adding a metallic substance to the metal in in the second container, the substance being readily oxidizable in a highly exothermic chemical relation, blowing oxygen into said metal to oxidize the substance thereby to elevate the temperature of the metal while continuing to deliver inert gas into the metal within the second container and maintaining vacuum pressure within the second container, said pressure being sufficient to degas said metal, discontinuing the blowing of oxygen and reducing the pressure in the vessel to said vacuum while continuing to deliver inert gas to the molten metal in the second ladle.

14. The method set forth in claim 13 wherein said substance is aluminum.

15. The method set forth in claim 14 wherein the inert gas is argon.

16. The method set forth in claim 13, 14 or 15 wherein a desulfurizing agent is added to the metal in the second container after transfer thereto from the first container for desulfurizing said metal while the pressure in the chamber is held at a high vacuum level and argon is delivered to the metal in the second container.

17. The method set forth in claims 13, 14 or 15 wherein the metal in the second ladle is maintained at a high vacuum and the inert gas is delivered beneath the surface thereof, until the hydrogen content of the metal falls below 0.0001%.

18. The method set forth in claims 13, 14 or 15 wherein the second ladle is disposed within a vacuum chamber, and removing the second ladle from the vacuum chamber after oxygen blowing and transporting said ladle to a deslagging station, removing the slag from the metal in the second ladle, returning the second ladle to the vacuum chamber, adding a synthetic slag, reestablishing the vacuum within the chamber and commencing a second oxygen blow to the metal in the second ladle, continuing the second oxygen blow until the level of aluminum is below 0.005%.

19. The method set forth in claims 13, 14 or 15 wherein the temperature of the metal in the second ladle is elevated to about 2815° F. to about 2930° F.

20. The method set forth in claims 13, 14 or 15 wherein calcium silicon is added to the metal in the second ladle after the oxygen blow.

* * * * *